United States Patent [19]

Eibe

[11] Patent Number: 4,557,028

[45] Date of Patent: Dec. 10, 1985

[54] COMPOSITE INFLATABLE CROWN ROLL

[75] Inventor: Werner W. Eibe, Pittsburgh, Pa.

[73] Assignee: White Consolidated Industries, Inc., Cleveland, Ohio

[21] Appl. No.: 490,254

[22] Filed: May 2, 1983

[51] Int. Cl.[4] ..... B21B 29/00

[52] U.S. Cl. ..... 29/113 R; 29/129

[58] Field of Search ..... 29/113 R, 113 AD, 116 AD, 29/118, 129

[56] References Cited

U.S. PATENT DOCUMENTS 3,604,086 9/1971 Bretschneider ..... 29/113 AD 4,242,781 1/1981 Takagawa et al. ..... 29/113 AD

*Primary Examiner*—Mark Rosenbaum

*Assistant Examiner*—Timothy V. Eley

*Attorney, Agent, or Firm*—Walter J. Blenko, Jr.; Arnold B. Silverman

[57] ABSTRACT

An inflatable crown roll for a rolling mill is made entirely from castings and has a cavity of very small radial dimension. In one embodiment the arbor is cast in the usual way. Its surface bounding the cavity is coated with a refractory composition that will disintegrate after being heated to casting temperature. A sand mold for the sleeve is then formed around a pattern, the pattern is removed, the cast arbor is positioned vertically in the sleeve mold and the sleeve is cast around the arbor. The sleeve metal temperature is regulated so that the sleeve fuses to the arbor at its necks. The disintegrated coating is flushed out through drill holes in the sleeve by fluid, leaving a cavity between arbor and sleeve. A sleeve with a composition of metal on its working face different from that of its neck portion may be cast by positioning gates with shut-off valves and risers at appropriate positions in the sleeve mold. Another embodiment of the sleeve is cast in a vertical mold provided with a sand core on a vertical support, the core having an external surface which bounds the cavity. After the casting solidifies the core and support are disintegrated and removed. The cast sleeve is then turned end-for-end and its interior is filled with molten metal of a composition which will shrink but will not fuse with the sleeve material. The shrinkage provides the cavity between sleeve and core.

8 Claims, 8 Drawing Figures

COMPOSITE INFLATABLE CROWN ROLL

This invention relates to inflatable crown rolls for rolling mill stands in which the variation of the crown is accomplished within the roll. It is more particularly concerned with such a roll which may be made entirely from castings.

BACKGROUND OF THE INVENTION

Variable crown rolls which require no roll bending apparatus comprise an arbor with a sleeve shrunk thereon together with means for introducing hydraulic fluid under pressure between arbor and sleeve to inflate the roll so as to bow or crown the sleeve. An example is the roll of Noe, et al., U.S. Pat. No. 3,457,617 of July 29, 1969. An improved roll of that type is disclosed in Eibe U.S. Pat. No. 4,062,096 of Dec. 13, 1977. Rolls of that type are costly to build. They also have inherent stress limitations because in some areas the high shrinkage stresses are compounded by additional inflation stresses. The shape of the cavity between the sleeve and the arbor is sometimes contoured to produce a more desirable crown profile. This contouring usually increases the oil volume which makes the roll "soft" or "spongy", to use the terminology of rolling mill operators. Rolls of that type must be manufactured largely, if not entirely, from forgings, the sleeve being shrunk on the arbor to fit tightly on each neck while leaving a cavity therebetween. It would be considerably more economical to make such a roll from a casting or castings, and it is the principal object of my invention to provide such a roll and a process for its manufacture.

SUMMARY OF THE INVENTION

The roll of my invention is a completely cast roll, both arbor and sleeve, having the sleeve and arbor effectively unitary at the neck regions but having a cavity between arbor and sleeve for receiving hydraulic fluid under pressure. It is desirable to have the radial dimension of the cavity as small as possible over its desired contour, as I have mentioned. In the roll of my invention, it can be no greater than that resulting from the shrinkage of one of the roll components.

In one embodiment of the process of my invention the arbor of the roll is cast vertically in a mold formed around an arbor pattern. The cast arbor is then machined, if desired, and that portion of its surface which will bound the cavity is given a thin coating of a refractory, preferably a ceramic, which becomes brittle and disintegrates after being heated to the casting temperature. The mold for the sleeve is formed around a pattern and positioned around the cast arbor, and the sleeve is cast in that mold against the arbor. After the sleeve has cooled the granular refractory is blown or washed out of the cavity by high-pressure fluid through bore holes drilled in the sleeve. The resulting cavity has a radial dimension which is the sum of the refractory coating thickness and the shrinkage of the sleeve. The metal for casting is heated to a temperature at which the arbor metal at the arbor necks just begins to liquify so that the arbor and sleeve fuse together in those areas.

The sleeve can be bottomed poured, or the neck and working portions may be cast from different metal compositions through separate gates spaced one above the other along the mold.

In another embodiment of my process a sleeve mold is formed around a pattern as above. A barrel-shaped core of sand or the like is positioned within the mold on a support extending through an axial opening at the lower end of the mold. After the casting has cooled the sand core is removed and the cavity so formed is filled with molten metal which is incompatible with the metal of the sleeve, that is to say, it will not fuse with the sleeve. After the mold has cooled a cavity will remain between core and sleeve having a radial dimension equal to the shrinkage of the core metal.

DESCRIPTION OF PREFERRED EMBODIMENTS

Figure 1:
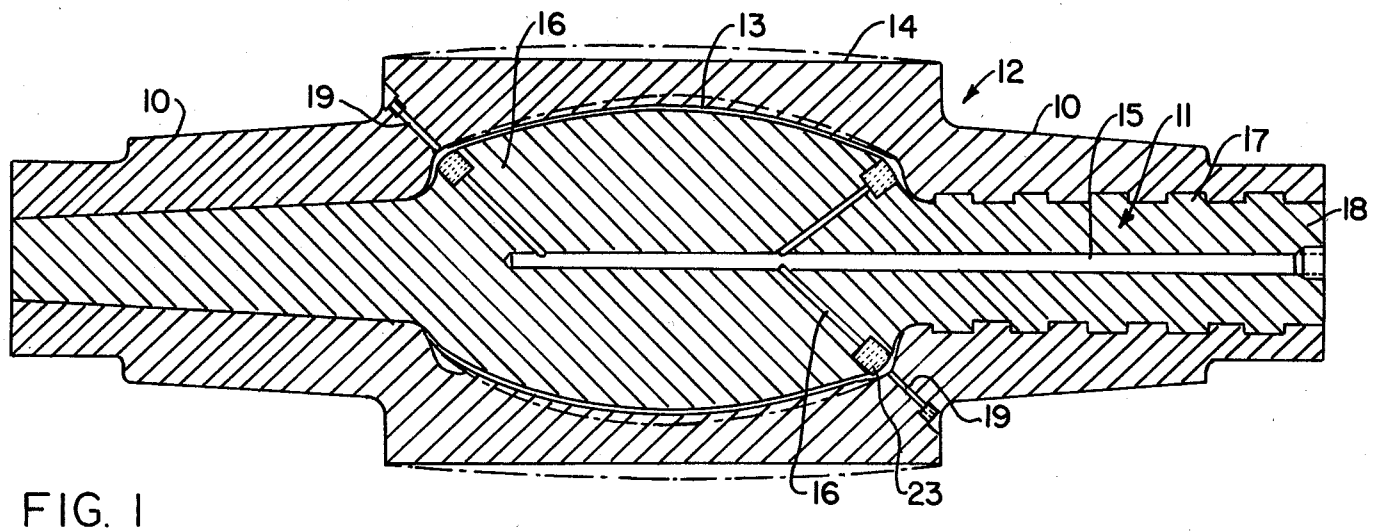
FIG. 1 is a longitudinal section through a first embodiment of the roll of my invention.

A first embodiment of my invention is shown in FIG. 1. The roll comprises an arbor 11 having a sleeve 12 fitting over it so as to leave a circumferential cavity 13 between arbor and sleeve only over the portion of the roll within its working face 14 between its load-bearing necks 10. An axial bore 15 extends through one neck 18 of arbor 11 into the roll interior and cross bores 16 connect axial bore 15 with cavity 13 so that fluid under pressure may be supplied to cavity 13 therethrough. Arbor 11 is cast in a sand mold or the like formed around a pattern and sleeve 12 is also cast in a mold formed around a pattern in which arbor 11 is positioned as will be described. In order to lock sleeve 12, and arbor 11 together at the roll necks, it may be desirable to machine the necks or ends 18 of arbor 11 into a corrugated surface 17 as shown. The metal cast into sleeve 12 has its temperature controlled so that it fuses with the arbor metal of necks 18.

Figure 3:
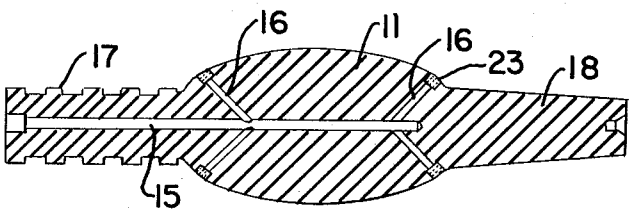
FIG. 3 is a longitudinal section through the arbor of the roll of FIG. 1 after machining and drilling.
Figure 4:
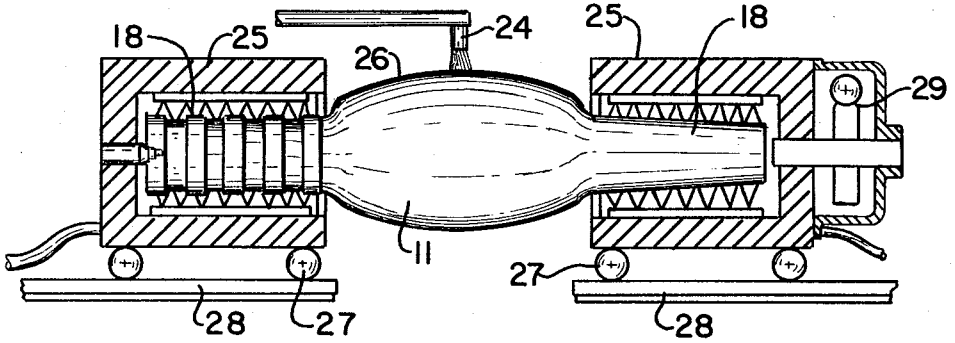
FIG. 4 is a longitudinal section through apparatus used for preheating the necks of the arbor of FIG. 3 and for coating its surface bounding the roll cavity.
Figure 2:
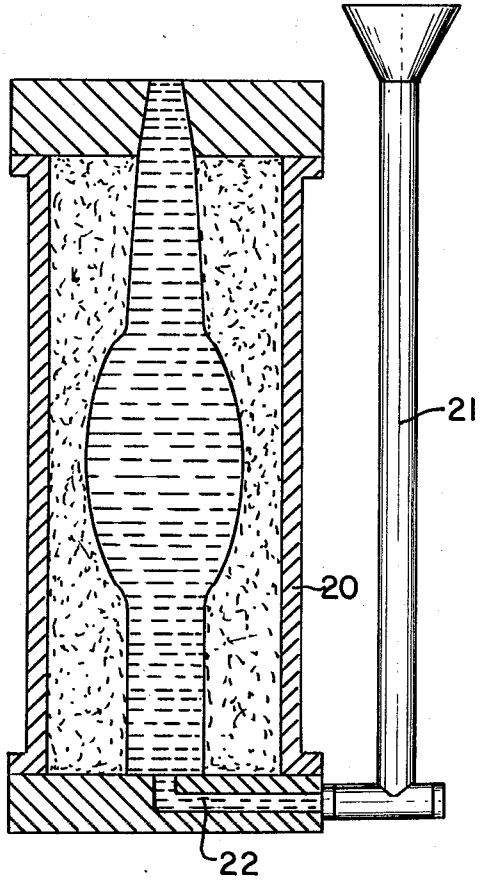
FIG. 2 is a vertical section through the mold for the arbor of the roll of FIG. 1.

The method of manufacturing the roll of FIG. 1 is shown in FIGS. 2–6 inclusive. The arbor 11 is bottom-cast vertically in a sand mold 20 formed around a pattern of the arbor. The molten metal is poured through riser 21 and flows into the mold at its bottom, through gate 22. Arbor 11 when solidified in the mold is removed therefrom and machined and drilled as is shown in FIG. 3. A refractory ceramic coating 26 is then sprayed over the periphery of the arbor which will form a boundary of the cavity from a nozzle 24, as is shown in FIG. 4. At the same time the necks 18 of arbor 11 may be preheated in heating furnaces 25 as are there shown which are movable toward and away from each other on wheels 27 running on tracks 28. Arbor 11 is rotated during spraying by rotating drive 29 carried in one of said furnaces 25.

I prefer to spray arbor 11 with a ceramic refractory such as zirconium oxide. The thickness of the spray coating is only that required to prevent fusing of the arbor metal with the sleeve metal when the sleeve is poured. The coating is compounded so that it will become embrittled at the casting temperature and break up into granular form upon cooling therefrom.

Figure 5:
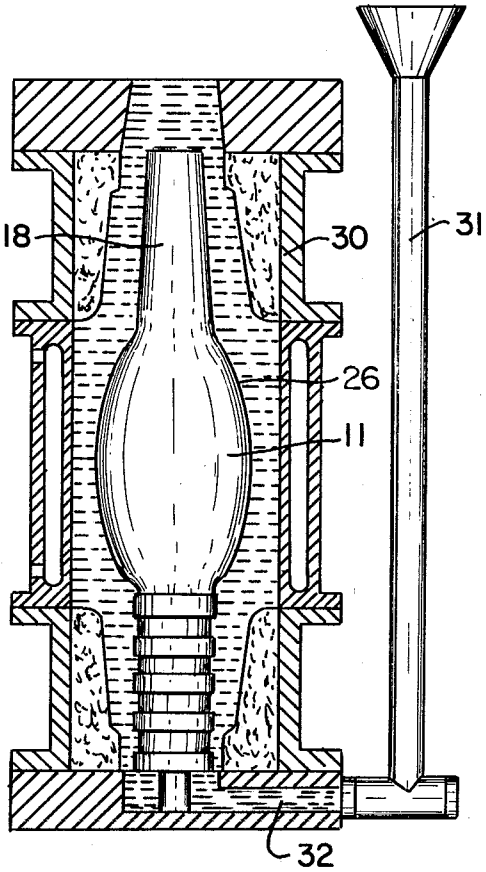
FIG. 5 is a vertical section through apparatus for casting the sleeve of the roll of FIG. 1.

Cross bores 16 are plugged at their outer ends with ceramic plugs 23 of the same material as coating 26. The sleeve 12 is cast vertically around arbor 11 with its ceramic coating 26 in a sand mold 30 formed over a pattern, as is shown in FIG. 5. The molten metal is teemed into riser 31 and flows into the space between arbor 11 and mold 30 through gate 32 with which riser 31 is connected. The metal is heated to a temperature sufficient to cause it to fuse to the ends 18 of arbor 11, which fusion is promoted by the preheating of ends 18 as has been described. The hot metal does not fuse with the arbor in the area of the arbor carrying ceramic coating 26. As has been mentioned, that ceramic composition is adjusted to become brittle at the casting temperature and crack or granulate at that temperature or in cooling therefrom. After the composite roll so formed has cooled it is removed from mold 30 and the ceramic coating 26, now in granular or particulate form, together with plug material 23, is blown or flushed out of cavity 13 by fluid introduced through bore 15 and drill holes 16. Bleeder bore holes 19 drilled through the shoulders of sleeve 12, as are shown in FIG. 1, provide exit means for the material of ceramic coating 26.

Figure 6:
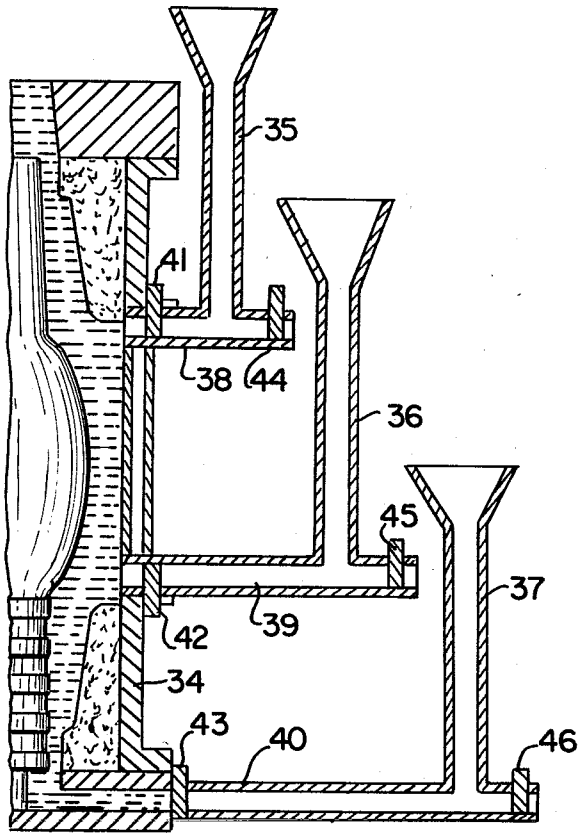
FIG. 6 is a vertical section through apparatus for casting the sleeve of a second embodiment of the roll of my invention.

A second embodiment of my invention is illustrated in FIG. 6. The process of casting arbor 11 and providing it with a ceramic coating 26 is carried out in the manner disclosed hereinabove and that arbor is assembled in a vertical sleeve mold 34. That mold differs from mold 30 previously described in that it is provided with three risers and three gates, the gates being positioned one above the other so as to communicate with different regions of the mold 34. Gate 38 is positioned at the upper end of the work face of the sleeve in its vertical position, gate 39 at the lower end of the sleeve work face, and gate 40 at the bottom of the mold, as was gate 32 previously described. Gate 38 is fed with metal teemed into its riser 35. Gate 38 has a shut-off valve 41 at its junction with mold 34, and overflow valve 44 at its outer end. Gate 39 has a like shut-off valve 42 at its junction with mold 34 and a like overflow valve 45 at its outer end. Gate 40 likewise has a like shut-off valve 43 at its junction with mold 34 and a like overflow valve 46 at its outer end. Hot metal is first teemed into riser 37 which feeds gate 40 and is allowed to flow through that gate into the bottom of mold 34. Shut-off valves 41 and 42 and overflow valves 44 and 45 of gates 38 and 39 respectively are opened. The hot metal fills mold 34 up to gate 39 and overflows therefrom, signaling that it has reached that level. The teeming of hot metal into riser 37 is then stopped, shut-off valve 43 is closed, and overflow valve 46 is opened to drain riser 37.

Hot metal is then teemed into riser 36 from which it flows through gate 39 into mold 34 and rises until it reaches gate 38, filling the sleeve mold to that level. When the hot metal overflows from gate 38 through valve 44, shut-off valve 42 is closed, teeming into riser 36 is stopped, and overflow valve 45 is opened. Shut-off valve 41 is then opened, overflow valve 44 is closed, and hot metal is teemed into riser 35 until the upper end of mold 34 is filled. My process as above described permits the working portion of the sleeve to be cast from metal of a different composition from that of the neck portions of the sleeve.

In both embodiments described above the radial dimension of cavity 13 is the sum of the thickness of coating 26 and the shrinkage of sleeve 12.

Figure 8:
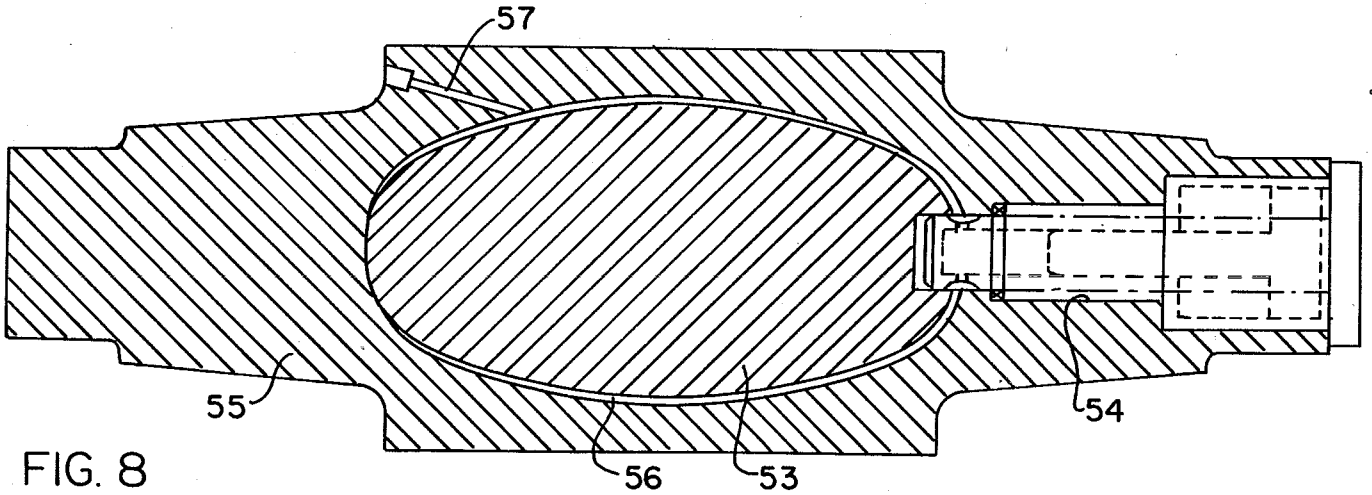
FIG. 8 is a longitudinal section through a third embodiment of the roll of my invention.

A third embodiment of my process together with its poroduct is shown in FIG. 8. A vertical sand mold similar to mold 30 is formed around a roll pattern and the pattern is withdrawn. In the mold cavity is positioned a barrel-shaped core such as core 53, which is supported from the mold bottom on an auxiliary core piece defining an internal passage 54. Core 53 and its auxiliary core piece are formed of sand or the like with a binder. Molten metal is then teemed into the mold through its upper end, forming a cast sleeve 55. When the sleeve has cooled the core 53 and auxiliary core piece are disintegrated and removed through passage 54. The casting is then turned end-for-end, air vent 57 is drilled into the casting, and molten metal is teemed into the sleeve cavity through passage 54, but only to the junction of that passage with the cavity formed by core 53. The metal for that teeming is selected to be incompatible with that of sleeve 55, that is to say that it will not fuse with that of sleeve 55. When metal core 53 cools it will shrink away from sleeve 55 around its surface, thus forming a surrounding cavity 56 which communicates with passage 54. That passage is preferably dimensioned to accommodate a pressure intensifier and high pressure seal of the types described in my U.S. Pat. No. 4,062,096.

Figure 7:
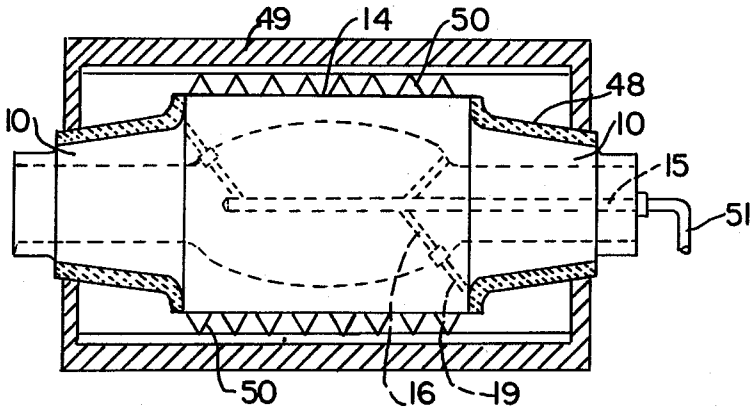
FIG. 7 is a longitudinal section through apparatus for heat treating rolls of my invention and for flushing out the coating from the roll cavity.

The rolls made by any of my processes above described may require heat treatment of their working faces to impart maximum hardness thereto. That treatment can be advantageously combined with the step of cleaning out the disintegrated ceramic coating from the roll cavity. FIG. 7 illustrates apparatus and method for those operations. The roll necks 10 are coated with a refractory composition 48 and the roll is placed inside the furnace chamber 49 supported by its necks. The furnace is provided with heating elements 50 which surround the working face 14 of the roll. Bore 15 is connected with an external source of fluid under pressure through pipe 51. Working face 14 is then heated by elements 15 while the fluid under pressure blows or flushes out refractory composition 26 through drill holes 16 and 19. Refractory composition 48 protects roll necks 10 so that they are not heated to the extent of working surface 14.

In the foregoing specification I have described a presently preferred embodiment of my invention; however, it will be understood that my invention can be otherwise embodied within the scope of the following claims.

I claim:

1. In an inflatable crown roll comprising an arbor member and a sleeve having a working face, said sleeve fitting closely on the arbor under the working face of said sleeve so as to leave a circumferential cavity between sleeve and arbor for receiving a fluid under pressure, the improvement comprising at least one of said members being a casting which is cast against the other member to fuse the sleeve to the ends of the arbor and form the sleeve and having a radial dimension substantially that due to the sleeve and arbor being sealed together to prevent leakage from the cavity.

2. The roll of claim 1 in which the circumferential cavity has a radial dimension substantially that due to the shrinkage between said members following said casting plus the thickness of a refractory coating on one of said members which prevents the fusing together thereof.

3. The roll of claim 1 or 2 in which the necks of the arbor are formed with annular key grooves which lock with the sleeve.

4. The roll of claim 1 or 2 including in its arbor an axial bore from one end into a central portion midway between the ends, and at least one cross bore from that axial bore into the cavity.

5. The roll of claim 1 or 2 including in its sleeve at least one bleeder bore from the cavity to the sleeve exterior.

6. An inflatable crown roll comprising a roll body having a central cavity therein, a cast core in that central cavity of material which fuses with the material of the roll body during casting only at the ends of the roll body and a circumferential cavity between the core and roll body for receiving fluid under pressure, the radial dimension of that cavity being substantially that due to the shrinkage of the core following said casting and the roll body and the core being sealed together to prevent leakage from the cavity.

7. The roll of claim 6 in which the central cavity is of substantially the same axial length as the working face of the roll.

8. The roll of claim 6 including at least one bleeder bore extending from the circumferential cavity to the roll body exterior.

* * * * *

UNITED STATES PATENT AND TRADEMARK OFFICE

CERTIFICATE OF CORRECTION

PATENT NO. : 4,557,028

DATED : Dec. 10, 1985

INVENTOR(S) : Werner W. Eibe

It is certified that error appears in the above-identified patent and that said Letters Patent is hereby corrected as shown below:

Column 4, line 7, "poroduct" should read --product--

Column 4, line 62 and 63, after "and" should read --arbor into a unitary member, the sleeve and arbor being sealed together to prevent leakage from the cavity.--.

Signed and Sealed this

*Seventeenth* Day of *June 1986*

[SEAL]

*Attest:*

DONALD J. QUIGG

*Attesting Officer*

*Commissioner of Patents and Trademarks*